US006167633B1

(12) United States Patent
Amara

(10) Patent No.: US 6,167,633 B1
(45) **Date of Patent: *Jan. 2, 2001**

(54) CURVE FORMING DEVICE

(75) Inventor: Thomas P. Amara, Southold, NY (US)

(73) Assignee: CLC Associates Inc., Southold, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/174,268

(22) Filed: Oct. 16, 1998

(51) Int. Cl.[7] ..... B43L 13/22
(52) U.S. Cl. ..... 33/561.2; 33/561.1; 33/512
(58) Field of Search ..... 33/561.2, 561.1, 33/561.3, 1 C, 1 K, 403, 483, 511, 512, 515

(56) References Cited

U.S. PATENT DOCUMENTS

| | | | | |
|---|---|---|---|---|
| 407,756 | | 7/1889 | Williams | 33/561.2 |
| 447,657 | | 3/1891 | Blake | 33/561.2 |
| 1,233,382 | * | 7/1917 | Malsin | 33/561.2 |
| 1,939,565 | * | 12/1933 | McKittrick | 33/561.2 |
| 3,134,176 | | 5/1964 | Hoyle | 33/561.2 |
| 3,724,083 | | 4/1973 | Mehl | 33/561.2 |
| 4,539,757 | | 9/1985 | Shyu | 33/561.2 |
| 4,993,164 | | 2/1991 | Jacobsen | 33/561.3 |
| 5,063,679 | * | 11/1991 | Schwandt | 33/371 |

* cited by examiner

*Primary Examiner*—Christopher W. Fulton
(74) *Attorney, Agent, or Firm*—Schweitzer Cornman Gross & Bondell LLP

(57) ABSTRACT

A curve forming device has a first elongated, flexible member with a plurality of equal-length projections extending perpendicularly from one side. The projections have end faces aligned parallel to the first elongated, flexible member. One portion of a hook-and-loop fastener is affixed to the end face of each projection. A second elongated flexible member has a complementary portion of the hook-and-loop fastener affixed along its entire length. To form a curve, one of the flexible members is pre-shaped into the desired curve. The, the other flexible member is attached by engaging the hook-and-loop fasteners on the projections to the fastener on the other flexible member. The curve forming device is then locked in place. Pressure sensitive adhesive can also be employed.

16 Claims, 8 Drawing Sheets

CURVE FORMING DEVICE

FIELD OF THE INVENTION

This invention pertains to the field of curve forming devices and, in particular, to curve forming devices for creating, copying, and transferring complex curves.

BACKGROUND AND SUMMARY OF THE INVENTION

In a wide array of applications, it is often desirable to create, trace, or copy curves or curved structures for use in creating, duplicating, and transferring the curve or for imparting a desired curve to an object. Examples of such applications include drafting, carpentry, boat hull design, landscaping, engineering, aeronautics, aerospace and prosthetics. It can be appreciated that there are numerous other applications for curve forming devices.

In mechanical drafting, curve formation has been done with the use of "flexible rules", which sometimes include two flexible strips of material that can be shaped into the desired curve and then locked together with a series of clamp screws, or the like. Examples of such flexible rules are disclosed in U.S. Pat. Nos. 407,756 and 447,657. These types of curve forming devices are generally effective; however, each individual fastening means must be separately and independently engaged and disengaged during use, this requires a significant amount of effort and time.

Other curve forming devices employ magnetic means and/or friction to attempt to maintain adjacent flexible members in a relative position to maintain a desired curve. Examples of these types of devices are disclosed in U.S. Pat Nos. 3,134,176; 3,724,083; and 4,539,757. These designs require less time and effort to adjust and disengage as compared to the previously-mentioned types of devices. However, they are subject to slippage which causes misalignment and loss of the desired curve.

Therefore, what is desired is a curve forming device for creating, copying and imparting complex curves, which device is easily locked and disengaged to form and change curve shapes and which, once locked in place, forms a rigid structure not susceptible to slippage.

The present invention provides a curve forming device which is applicable to an extremely wide variety of uses, and which overcomes the disadvantages of the prior designs.

The curve forming device of the present invention includes two flexible, elongated members which are joinable together by preferably releasable attachment means to form, or conform to, the shape of complex curves. One flexible member includes a plurality of projections rigidly affixed to and disposed along the length of the flexible member. Each projection extends outwardly perpendicular to the flexible member and includes an end face which is parallel to the flexible member. The attachment means preferably comprises hook-and-loop fasteners with one portion of the hook-and-loop fasteners affixed to the end face of each projection, and the complementary portion of the hook-and-loop fastener affixed to preferably the entire surface of the opposite flexible member. Thus, when the projections are urged against the opposite flexible member, the two flexible members will be locked in place until the two flexible members are separated.

It can be appreciated that the formation of a curve using the present invention is extremely efficient. To form or copy a curve, one of the flexible members is simply formed into the desired (or existing) shape. Then the other flexible member is quickly and easily attached to the preformed member. At this point the curve forming device is locked in place until disengaged by forcibly separating the two flexible members, thereby separating the hook-and-loop fasteners.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
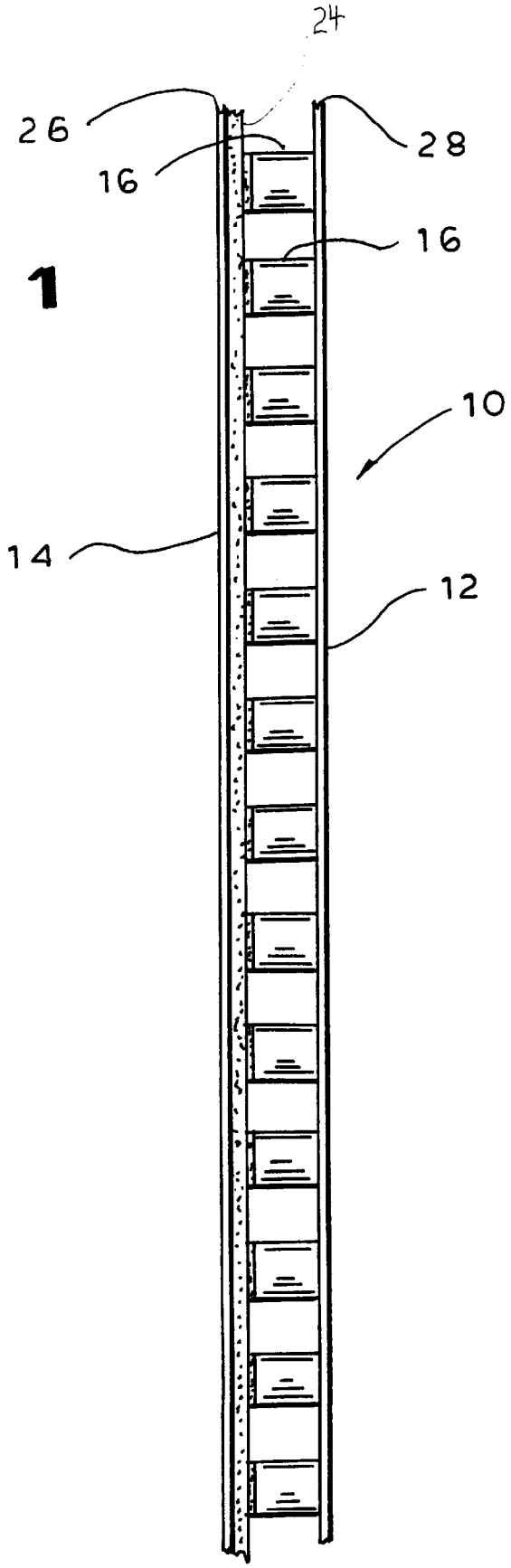
FIG. 1 is a side elevational view of a first embodiment of the curve transfer device of the invention.

Referring to FIGS. 1–4, the curve forming device 10 of the present invention includes two elongated flexible members 12, 14 preferably formed from flexible plastic sheeting. Each flexible elongated member has an opposing surface 13, 15, the opposing surface 15 of the second elongated flexible member 14 forms a continuous contact surface 17.

Fixedly attached to the opposing surface 13 of one flexible member 12 are a series of rigid projections 16, which are preferably of uniform shape and length and are preferably uniformly spaced at regular intervals along substantially the entire length of the flexible member 12. The projections 16 extend outwardly perpendicular from the opposing surface 13 of the flexible member 12 and include an end face 18 which is substantially parallel to flexible member 12. The projections can be connected to the flexible member 12 with any suitable fastener, such as screws or rivets, or the like. Alternatively, the projections 16 can be integrally formed with the flexible member 12, such as by injection molding or thermal forming. Affixed to the end face 18 of each projection 16 is a preferably releasably engageable attachment means 20. Affixed to an opposing surface 22 of the opposing flexible member 14 is a preferably complimentary attachment means 24 which cooperates with the releasable attachment means 20 affixed to the projections 16. The releasable attachment means 24 affixed to the opposing flexible member 14 is disposed substantially continuously along preferably the entire length of the contact surface 17, such that the complementary attachment means affixed to the projections 16 will securely mount at any location along the length of the contact surface 17.

The attachment means 20 is operable to substantially prevent relative motion of the two elongated flexible members at least along their respective longitudinal axes such that the shaped curve forming device will maintain its configuration.

Hook-and-loop fasteners, and the like, are suitable releasable attachment means for the curve forming device of the present invention. Preferably, one portion of the hook-and-loop fastener is rigidly affixed over the entire surface area of the end face 18 of each projection 16. A complementary portion of the hook-and-loop fastener is rigidly affixed over substantially the entire surface area and/or length of the contact surface 17 of the opposing flexible member 14.

It can be appreciated though that other types of attachment means are equally suitable. For example, one or both of the opposing flexible member 14 or projections 16 could include a pressure-sensitive adhesive thereon to provide a permanent or semi-permanent connection between the flexible members 12, 14. The attachment means should, however, engage upon contact.

Figure 2:
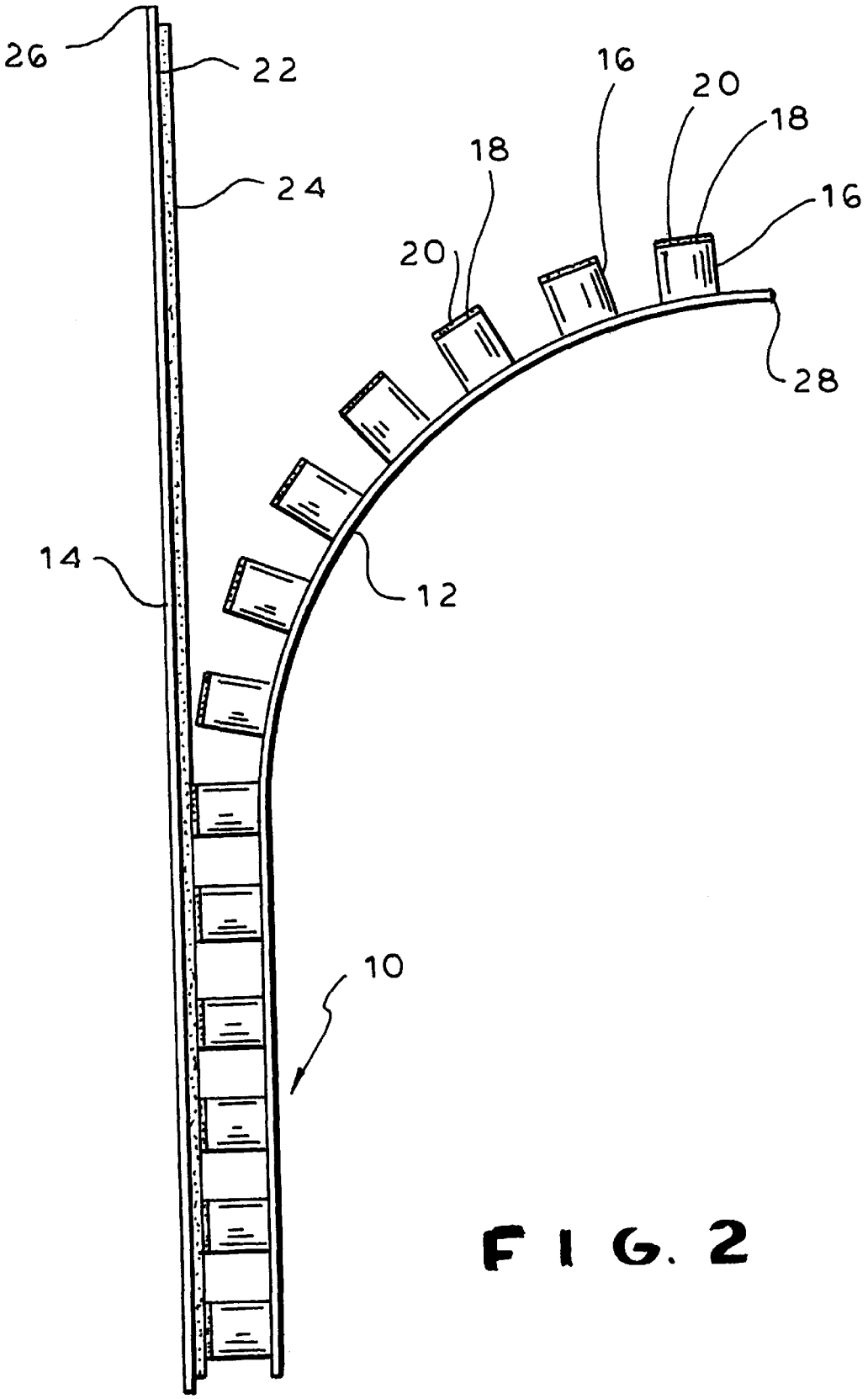
FIGS. 2 and 3 are side elevational views of the curve transfer device of FIG. 1.

As best shown in FIG. 2, to form (or copy) a curve, the flexible members 12, 14 are first partially or completely separated. Then, one flexible member (here, the flexible member 12 having the projections 16) is formed into the desired shape. Finally, the opposing flexible member 14 is connected to the pre-formed flexible member 12 with the projections 16 in contact with the contact surface 17 to secure the curve forming device 10 in the desired shape, as depicted in FIG. 3.

Figure 3:
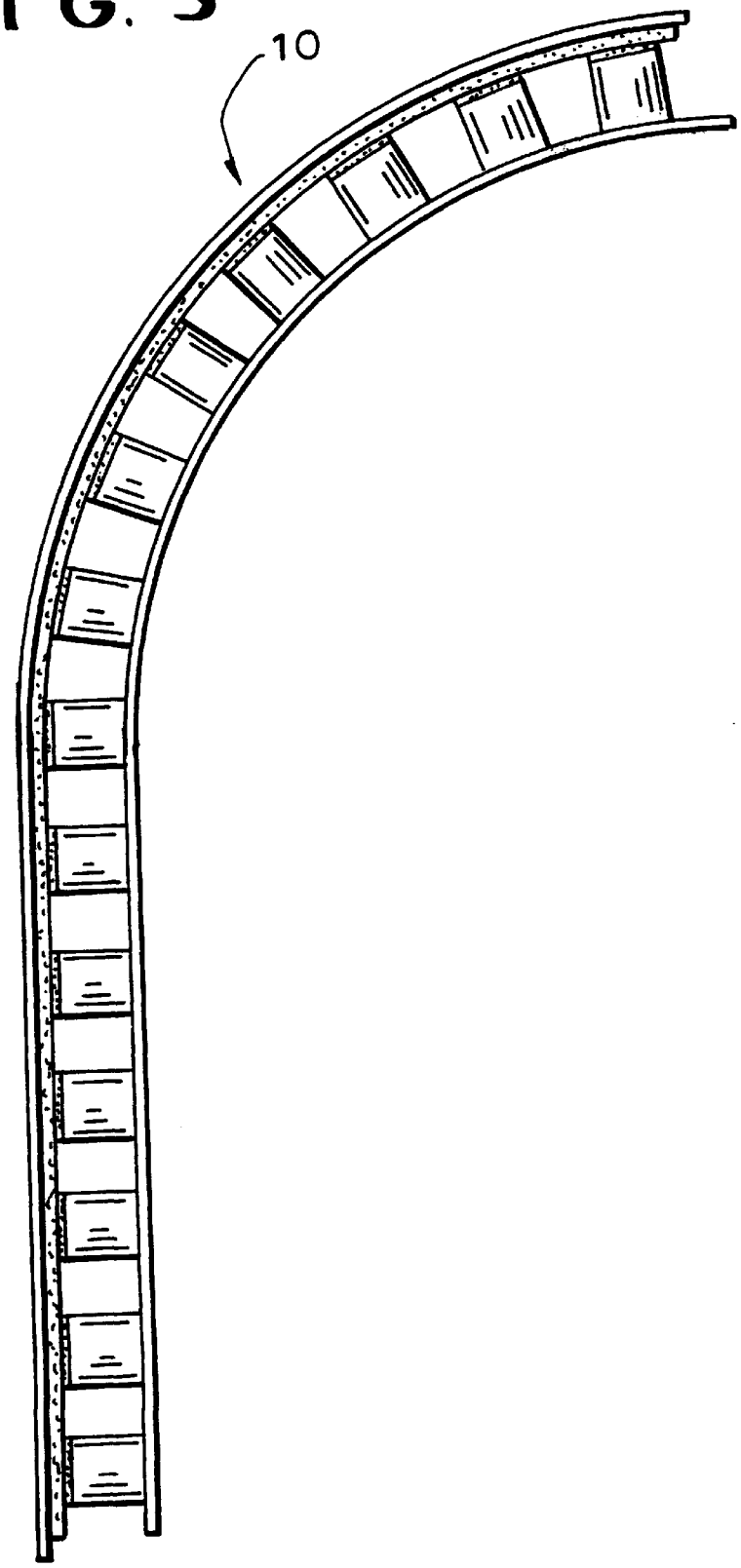

In attaching the opposing flexible member 14, it is preferable to begin at one end of the pre-formed flexible member 14, (e.g., the lower end as depicted in FIG. 3), sequentially connecting the two flexible members 12, 14 at successive projections 16. This ensures that each projection 16 will attach to the opposing flexible member 14 to provide a strong, rigid connection therebetween, such that the curve forming device 10 will maintain the desired shape even if it is subjected to a load.

To separate (and possibly reshape) the curve forming device 10, end portions 26, 28 of the flexible members 12, 14 are grasped and urged apart to detach the connection (if possible) between the projections 16 and the opposing attachment means. The remaining attachments are disengaged in sequence in a similar manner.

The projections 16 add rigidity to the curve device 10 by creating a distance between the two flexible members 12, 14 and thus between the two flexible members 12, 14 and a neutral axis of flexure of the assembled curve forming device 10. Thus, the spaced-apart flexible members 12, 14 act much like the opposed spaced-apart flanges of an I-beam which are interconnected by a spacing flange, to stiffen and strengthen the structure.

Preferably, the projections are substantially uniform in shape and length and have a height about 1.3 times a width thereof. The projections can be any suitable shape, such as cylindrical, rectangular, or square.

Figure 4:
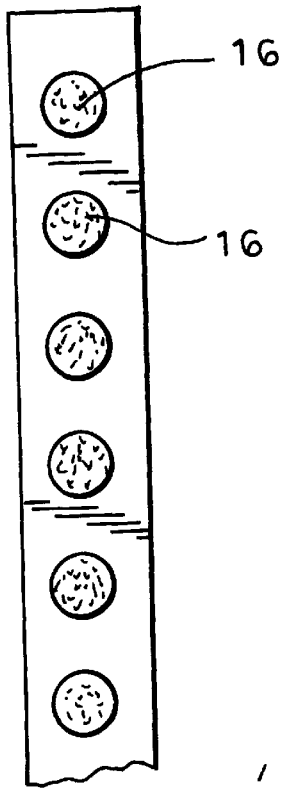
FIGS. 4 and 5 are front elevational views of one portion of the first and a second embodiment of the invention, respectively.
Figure 5:
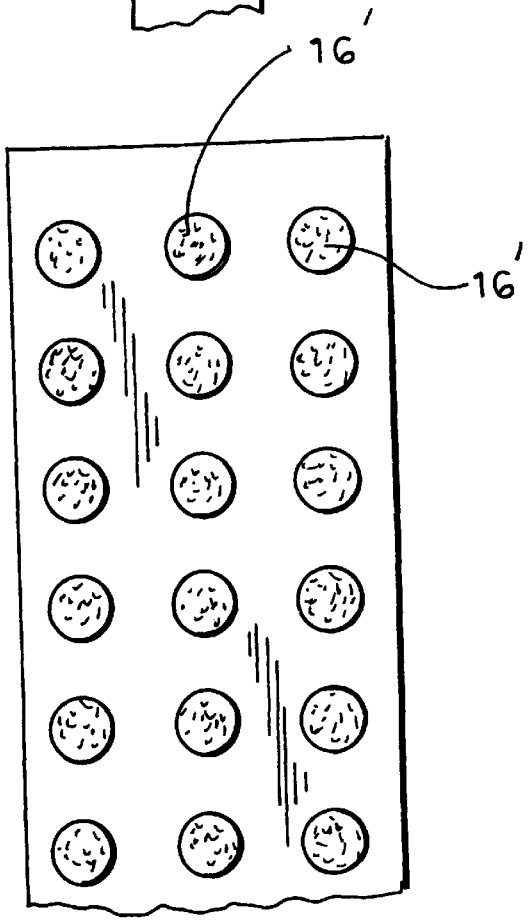
Figure 6:
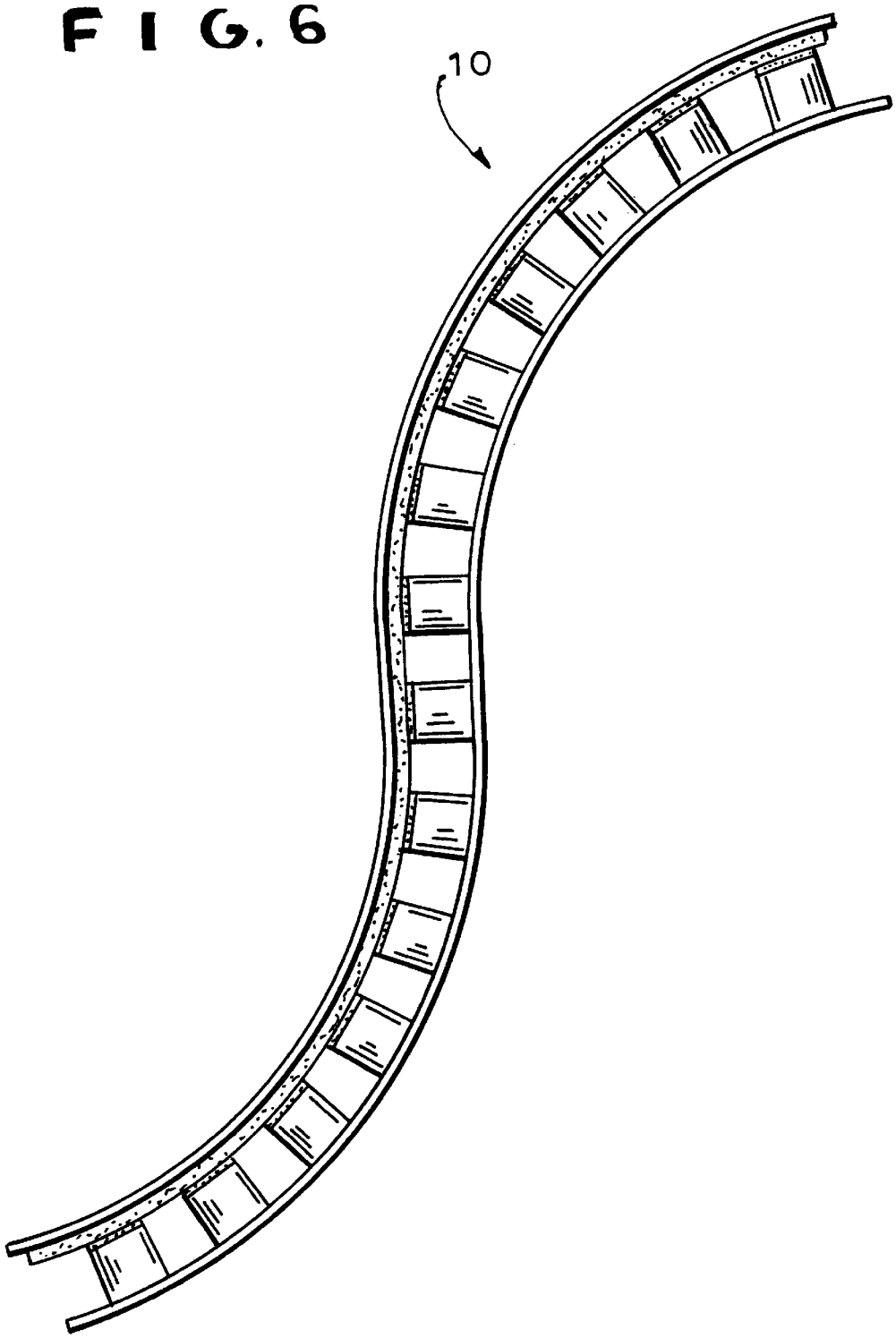
FIG. 6 is a side elevational view of the curve transfer device.

Referring to FIGS. 4 and 5, the projections 16 and 16' can be arranged in any desired configuration including a single column or a two-dimensional array. In addition, the curve forming device can be constructed in many sizes and gauges.

Referring again to FIG. 2, in one embodiment, the flexible members 12, 14 can be formed from 0.044 inch thick, 1.048 inch wide, plastic sheeting 3 feet in length and the projections can be cylinders each having a 0.625 inch diameter and a 0.780 inch height. The dimensions of the flexible members and the projections, and the strength of the hook-and-loop fasteners can be reduced or enlarged separately or concurrently depending on the length of the curve to be formed and the possible forces to which the device will be subject.

Figure 7:
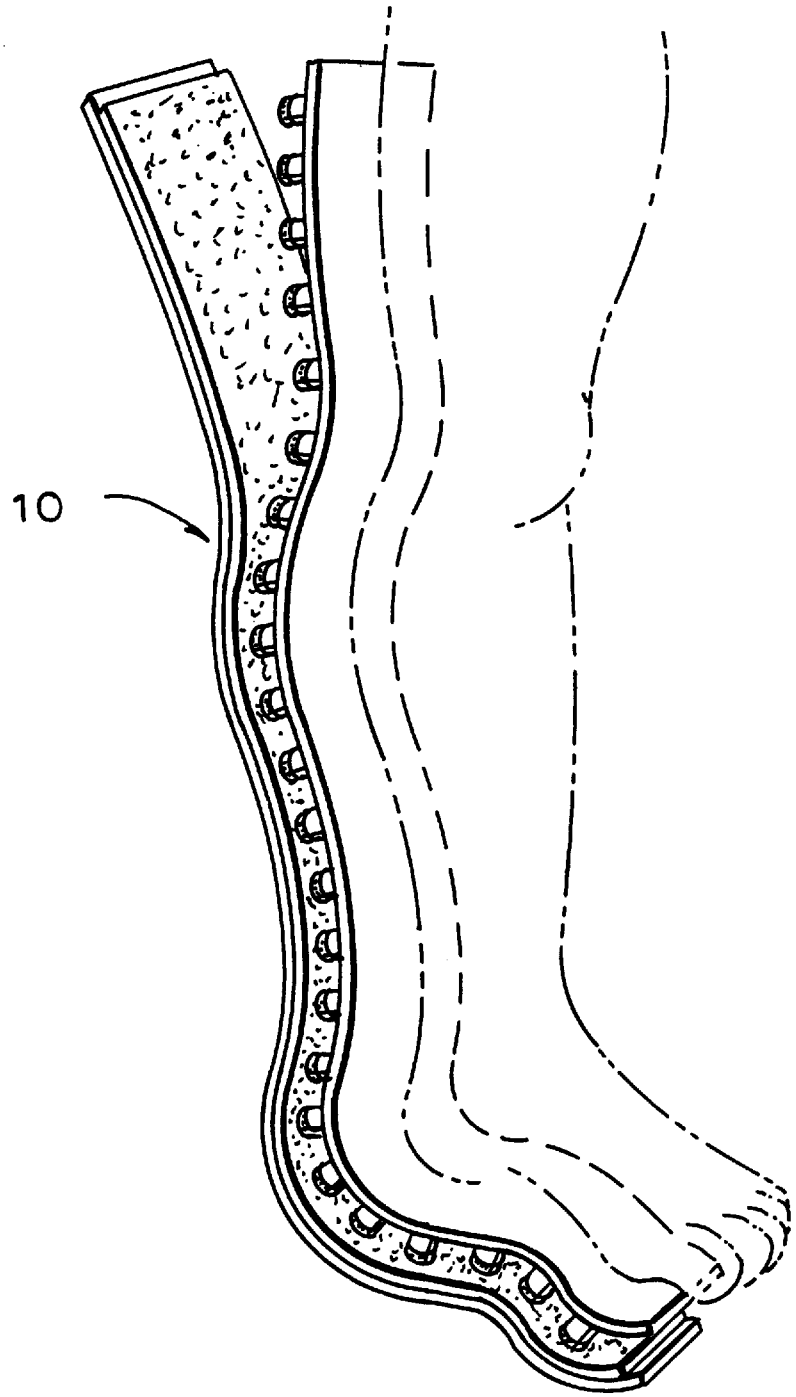
FIGS. 7 and 8 are perspective views of third and fourth embodiments of the invention, used as a splinting apparatus.
Figure 8:
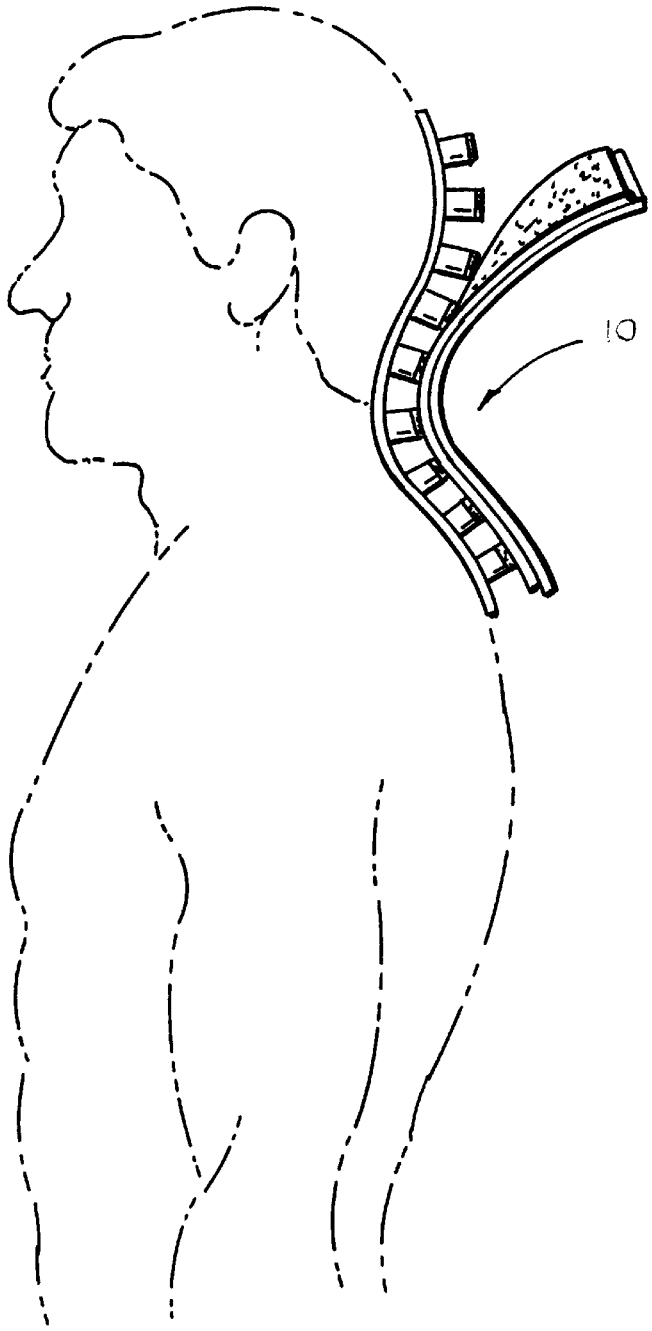

Referring to FIGS. 7 and 8, one of the many uses of the curve forming device 10 of the present invention includes modelling and shaping parts of the human body for such applications as prosthetic manufacturing or joint/limb immobilization, among others. In modelling human body parts, the curve forming device 10, while in a disengaged state, can be conformed to the shape of the body part. Then the opposing piece of the curve forming device 10 can be connected to lock the pre-formed portion in place and lock the curve. Joint and limb immobilization can be accomplished similarly by then affixing (such as with an adhesive wrap) the curve forming device to the associated body part.

The curve forming device 10 can also be used in a wide variety of other applications including boat hull design, drafting, carpentry, landscaping, aerospace engineering, display and backdrop construction, and many others.

Figure 9:
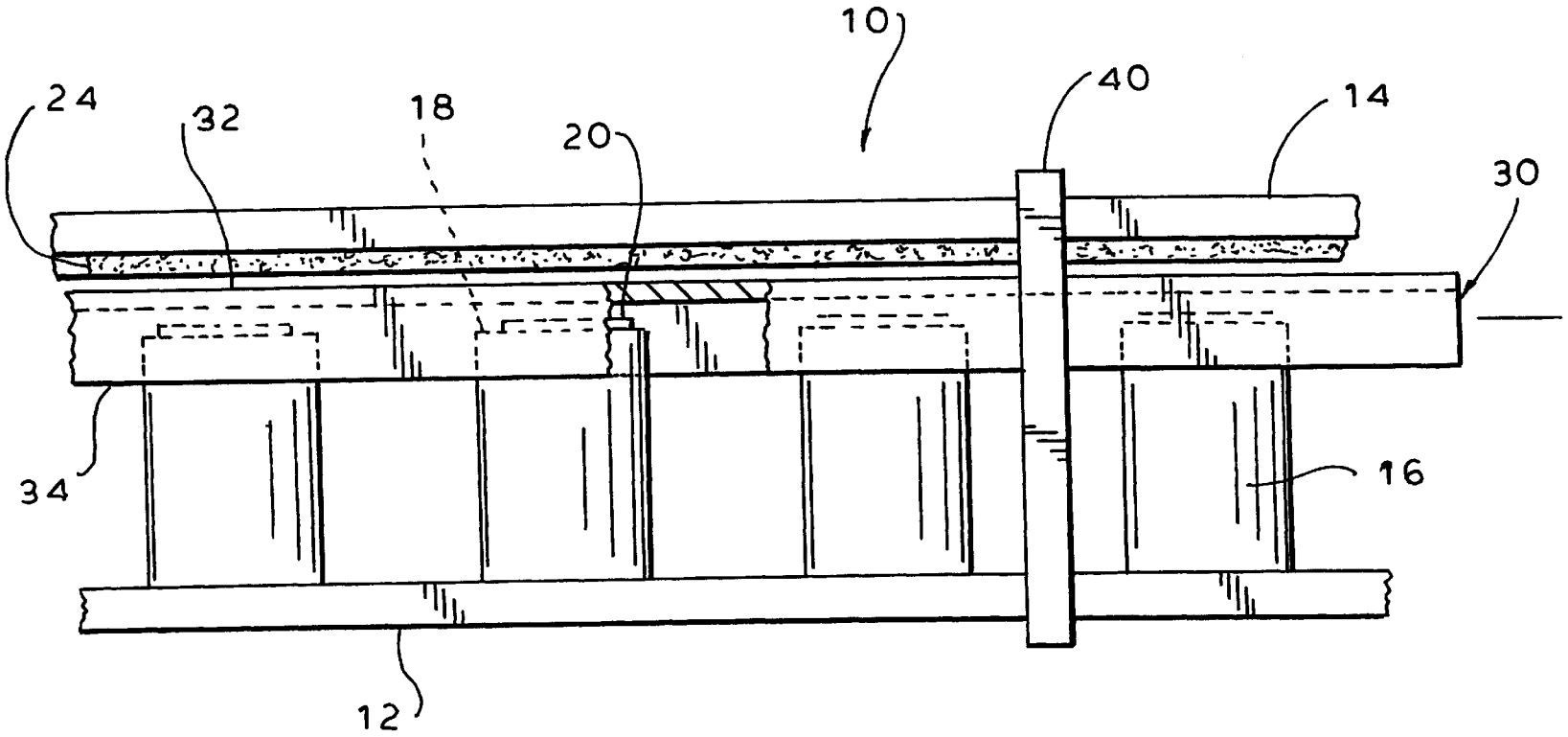
FIG. 9 is a side elevational view of a fifth embodiment of the invention, showing a removable separator.

Referring to FIG. 9, a particularly advantageous use of the curve forming device 10 of the present invention is for copying dynamic or changeable curves, or curves in constrained spaces. For this type of application, a removable separator 30 is used to prevent the releasable attachment means 20, 24, from connecting until the desired shape or the changing curve is attained, or until the curve forming device 10 is inserted into the constrained space. At the proper time, the separator 30 withdrawn from between the projections 16 and the opposing flexible member 14, thereby allowing the releasable attachment means to connect to form the desired curve.

Preferably the separator 30 is formed in the shape of a channel with a bottom 32 and two side portions 34, 36. The separator 30 is inserted over the projections with the bottom 32 resting on the end face 18 and releasable attachment means 20 of the projections 16. The opposing flexible member 14 is secured over the separator 30 and to the other flexible member via temporary fastening means such as a rubber band 40, or the like. The temporary fastening means 40 insures that the opposing flexible member 14 remains aligned with the projections 16, for eventual attachment thereto. The side walls 34, 36 of the separator 30 insure that the separator remains aligned over the projections 16 both when the curve is being formed and when the separator 30 is being withdrawn.

The curve forming device 10 provides an efficient and inexpensive means to create, copy and transfer curves to and between structures. The curve forming device can be used to semi-permanently or permanently assume the shape of an existing or desired complex curve by simply shaping one of the elongated flexible members as desired and then attaching the other flexible member to the pre-shaped member. Once connected, the two flexible members will retain the entire and exact curve thereby allowing the curve to be transferred analyzed or imparted on another structure. The device is easily reshaped by disengaging the releasable attachment means. As can be appreciated, the uses of the device are only limited by the imagination.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A curve forming device, comprising:

(a) first and second elongated flexible members, each having an opposing surface;

(b) a plurality of projections affixed to and extending outwardly from said opposing surface of said first elongated member, each projection having an end face;

(c) each projection having a disengaged position wherein said end face thereof is spaced away from said opposing surface of said second flexible member a substantial distance, and having an engaged position wherein said end face thereof is in contact with said opposing surface of said second flexible member;

(d) means for attaching said end faces of said projections to said opposing surface of said second flexible member, said attaching means being operable upon contact of said end faces of said projections with said opposing surface of said second flexible member, in said engaged position;

(e) said attaching means effectively preventing relative motion of said first and second flexible members along respective longitudinal axes, when said projections are in said engaged position;

(f) whereby said curve forming device can assume and retain the shape of a desired or existing curve by shaping one of said first or second elongated flexible members into the curve and placing said projections and said second flexible member in contact and whereby said curve forming device will not loose such shape until intentionally disengaged.

2. A curve forming device as in claim 1 wherein said opposing surface of said second elongated member forms a contact surface for attachment of said projections, which contact surface extends substantially continuously over a length of said opposing surface of said second elongated flexible member.

3. A curve forming device as in claim 1, wherein said projections are of substantially identical length, and are uniformly spaced apart.

4. A curve forming device as in claim 3 wherein said projections extend outwardly substantially perpendicular to said opposing surface of said first flexible member and wherein said end faces are aligned substantially parallel to said opposing surface of said first flexible member.

5. A curve forming device as in claim 1 wherein said attachment means comprises releasably engageable hook-and-loop fasteners.

6. A curve forming device as in claim 5, wherein a first part of said hook-and-loop fastener is affixed to said opposing surface of said second elongated flexible member and a second part of said hook-and-loop fastener is affixed to each of said end faces of said projections.

7. A curve forming device as in claim 6, wherein said first part of said hook-and-loop fastener is disposed substantially continuously along a length of said opposing face of said second elongated flexible member.

8. A curve forming device as in claim 7, wherein said attachment means substantially covers said end face of each said projection.

9. A curve forming device as in claim 1, wherein said projections have a height about 1.3 times a width thereof.

10. A curve forming device as in claim 1, wherein said projections are integrally formed in one piece, with said first flexible member.

11. A curve forming device as in claim 1, wherein said attaching means comprises pressure sensitive adhesive.

12. A curve forming device as in claim 11, wherein said pressure sensitive adhesive is disposed substantially continuously along a length of said opposing face of said second flexible member.

13. A curve forming device as in claim 1, wherein (a) said plurality of projections comprises a two-dimensional array of said projections;

(b) said attaching means being operable to attach each of said projections of said two-dimensional array to said second flexible member;

(c) whereby said curve forming device can be used to form multidimensional curves.

14. A curve forming device as in claim 1, further comprising (a) an integral, flexible separator removably displaced between each end face of said projections and said opposing face of second flexible member;

(b) said separator, when in an inserted position, being operable to prevent engagement of said attaching means;

(c) said separator being removable from said inserted position by withdrawal from between said projections and said second flexible member; and (d) said attaching means being operable upon removal of said separator.

15. A curve forming device as in claim 14, wherein said separator is in the shape of a channel having a bottom and two side portions, said bottom of said channel being disposed between said end faces of said projections and said second flexible member when said separator is in said inserted position.

16. A curve forming device as in claim 15, wherein said separator is in said inserted position, and temporary fastening means is disposed around said first and second flexible members.

* * * * *